US011260440B2

(12) United States Patent
Cmiel et al.

(10) Patent No.: US 11,260,440 B2
(45) Date of Patent: Mar. 1, 2022

(54) CATERPILLAR-TRACTION DRAWING MACHINE AND DRAWING METHOD

(71) Applicant: SMS group GmbH Sitz Duesseldorf, Duesseldorf (DE)

(72) Inventors: Thomas Cmiel, Moenchengladbach (DE); Joerg Lindbuechl, Moenchengladbach (DE); Dirk Hessberger, Moenchengladbach (DE)

(73) Assignee: SMS group GmbH Sitz Duesseldorf, Duesseldorf (DE)

( * ) Notice: Subject to any disclaimer, the term of this patent is extended or adjusted under 35 U.S.C. 154(b) by 215 days.

(21) Appl. No.: 15/989,270

(22) Filed: May 25, 2018

(65) Prior Publication Data

US 2018/0339328 A1 Nov. 29, 2018

(30) Foreign Application Priority Data

May 26, 2017 (DE) ..... 10 2017 111 557.9
Apr. 9, 2018 (DE) ..... 10 2018 108 355.6

(51) Int. Cl.
*B21C 1/30* (2006.01)
*B21C 1/28* (2006.01)
*B21C 1/20* (2006.01)

(52) U.S. Cl.
CPC ..... *B21C 1/305* (2013.01); *B21C 1/20* (2013.01); *B21C 1/28* (2013.01); *B21C 1/30* (2013.01)

(58) Field of Classification Search
CPC .. B21C 1/32; B21C 1/305; B21C 1/30; B21C 1/20; B21C 1/27; B21C 1/28; B21D 43/006; B30B 5/04; B30B 5/06; B02C 19/0006; B65G 17/067; B65G 17/42; B65G 17/44; B65G 15/14; B65G 15/12; B65H 51/14
(Continued)

(56) References Cited

U.S. PATENT DOCUMENTS 5,326,010 A * 7/1994 Moras ..... B21C 1/30 226/170
5,918,671 A * 7/1999 Bridges ..... E21B 19/22 166/77.3
(Continued)

FOREIGN PATENT DOCUMENTS

CN 101801554 B 8/2010
CN 102667185 A 9/2012
(Continued)

OTHER PUBLICATIONS

Taiwanese Office Action in Taiwanese Application No. 107117107, dated May 29, 2020 with English translation.

*Primary Examiner* — Gregory D Swiatocha
(74) *Attorney, Agent, or Firm* — Collard & Roe, P.C.

(57) ABSTRACT

A caterpillar-traction drawing machine and a method for drawing of elongated workpieces can be provided with at least one drawing tool fastened pivotally on a tool holder and/or with at least two identical drawing recesses, which can be brought selectively into a drawing position, so that the influence of any fatigue phenomena that may exist is minimized. For the same reason, a caterpillar-traction drawing machine is advantageous in which the two chains of the caterpillar-traction unit are block chains and are respectively braced via an idler roller chain including idler rollers on respectively one pressing beam.

29 Claims, 6 Drawing Sheets

(58) Field of Classification Search
USPC ..... 198/604, 620, 626.1, 626.5, 867.15
See application file for complete search history.

(56) References Cited

U.S. PATENT DOCUMENTS

| | | | | |
|---|---|---|---|---|
| 6,230,955 | B1 * | 5/2001 | Parks | B65G 37/005 226/190 |
| 6,450,386 | B1 | 9/2002 | Hessberger et al. | |
| 7,937,980 | B2 | 5/2011 | Hessberger et al. | |
| 8,132,617 | B2 * | 3/2012 | Magnus | E21B 19/22 166/77.3 |
| 2011/0048694 | A1 * | 3/2011 | Maschek, Jr. | E21B 19/22 166/77.3 |

FOREIGN PATENT DOCUMENTS

| | | | | |
|---|---|---|---|---|
| DE | 199 47 806 | A1 | 4/2001 | |
| EP | 0 548 723 | B2 | 4/1998 | |
| EP | 0 864 382 | A1 | 9/1998 | |
| EP | 1 210 187 | B1 | 7/2003 | |
| EP | 1 385 647 | B1 | 10/2004 | |
| EP | 2 197 601 | B1 | 3/2011 | |
| WO | 2006/002613 | A1 | 1/2006 | |
| WO | 2009/037320 | A1 | 3/2009 | |
| WO | WO-2009037320 | A1 * | 3/2009 | B21C 1/28 |
| WO | WO-2015075638 | A1 * | 5/2015 | B21C 1/30 |

* cited by examiner

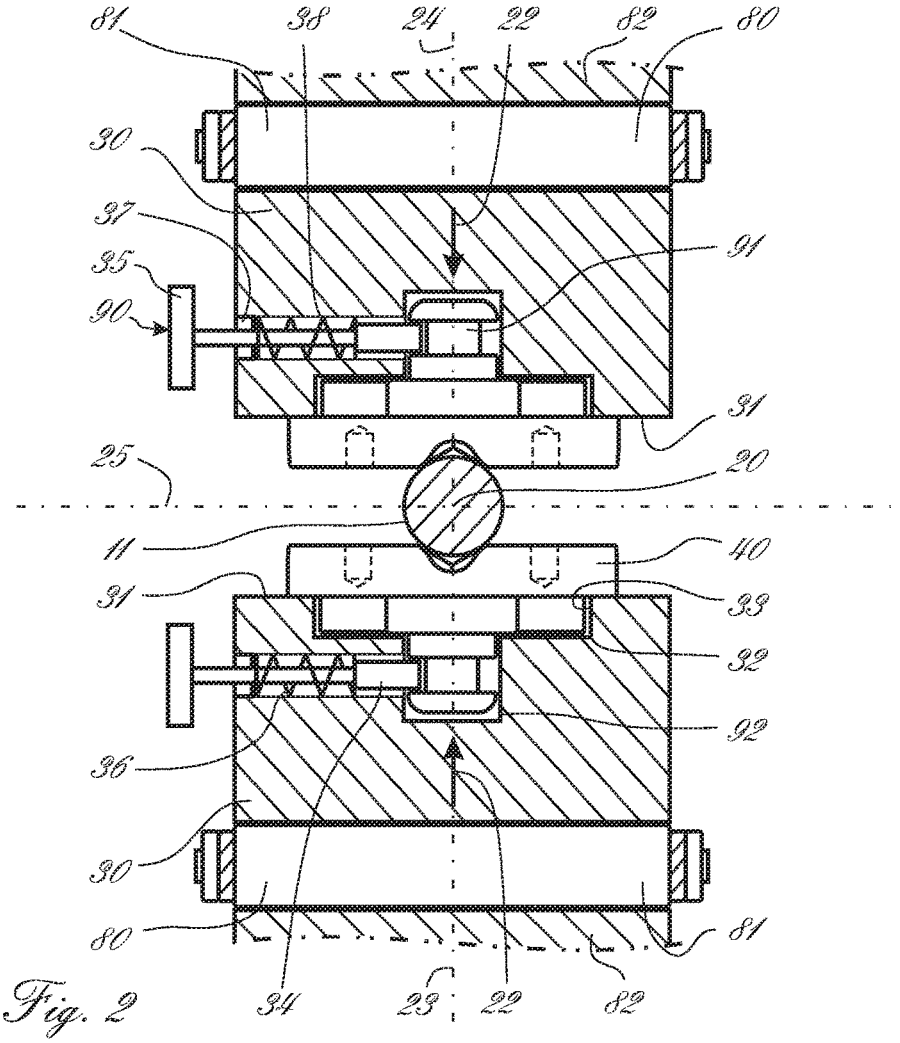
Fig. 2
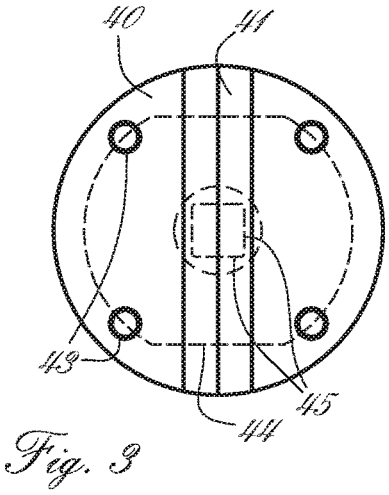
Fig. 3
Fig. 4
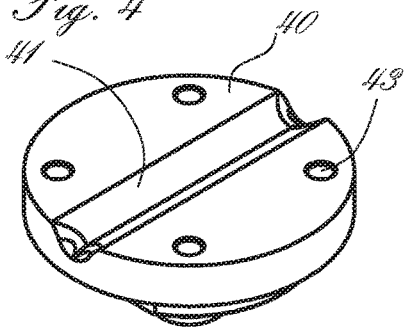
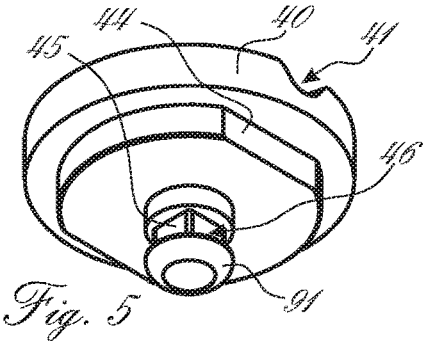
Fig. 5

CATERPILLAR-TRACTION DRAWING MACHINE AND DRAWING METHOD

CROSS REFERENCE TO RELATED APPLICATIONS

Applicant claims priority under 35 U.S.C. § 119 of German Application Nos. 10 2017 111 557.9 dated May 26, 2017 and 10 2018 108 355.6 filed Apr. 9, 2018, the disclosures of which are incorporated by reference.

BACKGROUND OF THE INVENTION

1. Field of the Invention

The invention relates to a caterpillar-traction drawing machine. Likewise, the invention relates to a drawing method.

2. Description of the Related Art

Such caterpillar-traction drawing machines and such drawing methods are known, for example, from EP 0 864 382 A1, from DE 199 47 806 A1, from EP 1 385 647 B1, from WO 2006/002613 A1, from EP 0 548 723 B2, from EP 2 197 601 B1 or from EP 1 210 187 B1, and are respectively used for drawing of elongated workpieces in a drawing direction along a drawing line through a drawing die by means of a caterpillar-traction unit disposed in drawing direction down-line from the drawing die. These caterpillar-traction units are provided with at least two revolving chains, which respectively have at least one tool holder respectively carrying a drawing tool in a drawing position and pressing means for application of a pressing force on the respective drawing tools with a component directed toward the drawing line.

SUMMARY OF THE INVENTION

It is an object of the present invention to provide a caterpillar-traction drawing machine of the stated type and a drawing method of the stated type in which the influence of any fatigue phenomena that may exist is minimized.

These and other objects are accomplished by caterpillar-traction drawing machines and drawing methods having the features according to the invention. Further advantageous configurations, which as the case may be are also independent thereof, are specified in or implicit from the following description.

Thus a caterpillar-traction drawing machine for drawing of an elongated workpiece in a drawing direction along a drawing line through a drawing die, comprising the drawing die and a caterpillar-traction unit disposed in drawing direction down-line from the drawing die, with at least two revolving chains, which respectively have at least one tool holder respectively carrying a drawing tool in a drawing position, and with pressing means for application of a pressing force on the respective drawing tools with a component directed toward the drawing line, wherein the respective drawing tool is provided with at least one drawing recess, in its drawing position in a gripping region of the caterpillar-traction unit is resting with one of its drawing recesses on the workpiece and by means of the pressing means is pressed against the workpiece, can be characterized in that at least one of the drawing tools is fastened pivotally on the tool holder, in order to minimize the influence of any fatigue phenomena that may exist. With suitable procedure, it is possible to react particularly efficiently to fatigue phenomena of the material from which the drawing tools are prepared, for example by pivoting the drawing tools.

Such a pivotal fastening of the drawing tool on the tool holder ensures that the drawing tool can be pivoted by 180°, for example. In this case, the drawing recess is also pivoted by 180°. Because of this 180° pivoting, this same drawing recess, with suitable configuration, can be used in both directions for several drawing processes.

On the one hand, therefore, the tool can be pivoted by 180°, for example, and in the pivoted position be used once again for drawing, in order, for example, to counteract a unilaterally resultant frictional force, whereby fatigue phenomena, such as hair cracks or roughness differences, for example, are able to develop. Thus the tool can be used for substantially longer.

It is also conceivable that the workpiece, for example, is pivoted only by 90°, wherein preferably two drawing recesses are then disposed at right angles to one another on the drawing tool. In this case, it is possible, by a pivotal fastening of the drawing tool on the tool holder, to select a new active drawing recess in structurally simple manner for subsequent drawing processes, which accordingly can likewise be used to counteract fatigue phenomena. Optionally, different drawing recesses offset by respectively 90° may also be provided, so that then the respective drawing tool can be adapted rapidly and operationally safely by pivoting to different workpieces. On the other hand, it is advantageous to provide correspondingly identical drawing recesses, so that the risk of fatigue phenomena can be effectively countered by pivoting respectively by 90° or 180°.

The pivotal fastening of the respective drawing tool on the corresponding tool holder makes it possible to execute the one corresponding displacement of the respective drawing tool on the respective tool holder rapidly and operationally safely.

Moreover, a caterpillar-traction drawing machine for drawing of an elongated workpiece in a drawing direction along a drawing line through a drawing die, comprising the drawing die and a caterpillar-traction unit disposed in drawing direction down-line from the drawing die, with at least two revolving chains, which respectively have at least one tool holder respectively carrying a drawing tool in a drawing position, and with pressing means for application of a pressing force on the respective drawing tools with a component directed toward the drawing line, wherein the respective drawing tool has at least one drawing recess, in its drawing position in a gripping region of the caterpillar-traction unit rests with one of its drawing recesses on the workpiece and by means of the pressing means is pressed against the workpiece, can be characterized in that at least one of the drawing tools is provided with two identical drawing recesses, which can be brought selectively into a drawing position, in order to minimize the influence of any fatigue phenomena that may exist.

With suitable procedure, it is also possible hereby to react particularly efficiently to fatigue phenomena of the material from which the drawing tools are prepared, for example by pivoting or otherwise displacing the drawing tools, in order to bring respectively one of the identical drawing recesses selectively into the drawing position, so that on the whole the drawing tools fatigue less rapidly in the region of their drawing recesses.

The two identical drawing recesses make it possible, with suitable procedure, to reduce the wear of the tool, since by the alternation between the identical drawing recesses the entire load acting on the drawing tools in the region of the drawing recesses can be correspondingly reduced.

Thus a second identical drawing recess may be present, for example at right angles to the first drawing recess. In order to adjust this second identical drawing recess, the tool is pivoted by 90°. The second drawing recess is selected to be identical to precisely the first drawing recess, so that the second identical drawing recess can be used for the same drawing process or for the same size of the workpiece to be drawn. It will be understood that not only a pivoting, but also a different kind of displacement, for example a lateral shift or similar, may be used appropriately in order to change the position of the two drawing recesses correspondingly. Thereby the wear of the tool is substantially reduced. For example, the possibility exists, by displacing the workpiece, of varying arbitrarily often between the drawing recesses during the drawing process, so that it is also possible in particular to use and thus wear the two identical drawing recesses in both directions. Thereby a more uniform wear of the entire drawing tool is possible, in which case the drawing tool as a whole lasts much longer and no early tool change, which would lead to interruptions and thus to impairment of the activities, is necessary.

It will be understood that a drawing recess may also be used optionally in both directions, in order nevertheless to provide a second identical drawing recess, which is likewise used in order to minimize fatigue phenomena on the whole.

It is also conceivable to use the first drawing recess, especially in both drawing directions, until its complete wear, and then to use the second identical drawing recess, pivoted by 90 degrees, for example, for the drawing process. This procedure provides the advantage that, after the wear of the first drawing recess, a complete tool change and thus a shutdown of the machine, as is common in the prior art, is not necessary, but instead the complete tool change is replaced by merely a corresponding displacement of the drawing tool by 90° or 180°, for example, because drawing can be continued with the second identical drawing recess, which is not yet worn. Optionally, it is also possible here to achieve, in the opposite direction, yet another use in which a drawing recess offset by 180° is used correspondingly.

Advantageously, the two identical drawing recesses are also used respectively in both drawing directions. During the use in only one direction, the surface of the drawing recess may be deformed correspondingly. Due to the drawing in the correspondingly other direction, the surface is then able to be reshaped again, so that on the whole a drawing recess can be used for substantially longer. Thus it should again be possible at least partly that defects due to deformations can be even eliminated or minimized.

It will be understood that the two identical drawing recesses may be placed at any arbitrary angle relative to one another, for example, on the drawing tool. This ability may be advantageous, for example, when it is desired to undertake an even faster change from the first drawing recess to the second drawing recess, wherein the workpiece only has to be pivoted by less than 90°. In this way, it is also then possible optionally to provide even further drawing recesses on a drawing tool. On the other hand, it will be understood that the drawing recesses may also be positioned next to one another or otherwise in spatial relationship to one another on the respective drawing tool, provided bringing of the respective drawing recesses of the respective drawing tool into its drawing position is possible, in which case it is certainly of advantage when this positioning can be executed as simply and operationally safely as possible. For the latter reason, an arrangement of the drawing recesses on a pivotable drawing tool at angles relative to one another or on a laterally positionable drawing tool next to one another seems particularly advantageous.

Preferably, at least one drawing tool of each chain, but naturally especially all drawing tools of one or preferably both chains, are fastened pivotally on the tool holder and/or have at least two identical drawing recesses, which can be brought selectively into a drawing position. Hereby the corresponding advantages can be exploited for the corresponding drawing tools. Accordingly, the respective drawing tools can be pivoted or their drawing recesses can be brought into their drawing position.

Preferably, one of the drawing tools is fastened pivotally on the tool holder and has at least two different drawing recesses, which can be brought selectively into a drawing position. By two different drawing recesses, it is possible, for example, to draw workpieces with different sizes. For example, no laborious tool change is then necessary between a drawing process for a workpiece with the diameter A via use of the drawing tool with the diameter A and a second production process with a diameter B and the use of a drawing tool with the diameter B. Between such production processes, for example, then only a pivoting of the workpiece by 90° is necessary, because the second different drawing recess pivoted by 90° relative to the first drawing recess provides the matching diameter for the second production process. In this case, therefore, one and the same tool can be used for several workpieces of different diameters or profiles without necessitating a tool change for the purpose. This feature is obviously accompanied by considerable improvements in the cycle times, because for the time being the tool does not have to be completely replaced, possibly even resulting in a shutdown of the machine.

Furthermore, a method for drawing of elongated workpieces in a drawing direction along a drawing line through a drawing die by means of a caterpillar-traction unit disposed in drawing direction down-line from the drawing die, with at least two revolving chains, which respectively have at least one tool holder respectively carrying a drawing tool in a drawing position, wherein the two chains are disposed in such a way and revolve in such a way that drawing tools carried by them come into contact in their drawing position with a drawing recess on the workpiece, are pressed against the workpiece and in this way apply traction forces on the workpiece, can be characterized in that, after or during the drawing of a workpiece, when the drawing tool is not being pressed against the workpiece, at least one of the drawing tools remains pivoted on the tool holder. In this way, the influence of any fatigue phenomena that may exist is minimized. By the pivoting, another region of the respective drawing tool, especially another drawing recess, for example, or even another alignment of an existing drawing recess, can be brought into drawing position, so that with suitable process control in all other respects, fatigue phenomena can be reduced to a minimum.

A method for drawing of elongated workpieces in a drawing direction along a drawing line through a drawing die by means of a caterpillar-traction unit disposed in drawing direction down-line from the drawing die, with at least two revolving chains, which respectively have at least one tool holder respectively carrying a drawing tool in a drawing position, wherein the two chains are disposed in such a way and revolve in such a way that drawing tools carried by them come into contact in their drawing position with a drawing recess on the workpiece, are pressed against the workpiece and in this way apply traction forces on the workpiece, can be characterized in that at least one further identical drawing recess at least of one of the drawing tools is brought into a drawing position, in order to be able to minimize the influence of any fatigue phenomena that may exist. In this case the bringing of the drawing recesses into the respective drawing positions can take place in any suitable way, especially by a displacement or by a pivoting, provided a change can be assured operationally safely. Even here, therefore, fatigue phenomena can be minimized in their influence with process control appropriately configured in all other respects.

It will be understood that the advantages mentioned in the foregoing already develop when only a single drawing tool is correspondingly configured or when only one drawing tool is bought correspondingly into other positions. In particular, however, it is of advantage to correspondingly form all drawing tools so that all drawing tools can be correspondingly relieved with respect to their fatigue phenomena. Depending on specific process control, all drawing tools can also be brought appropriately into other positions between two drawing processes, in which case it is also conceivable to bring only the drawing tools that exhibit corresponding or large fatigue phenomena appropriately into other positions, while the remaining drawing tools are still left in their position.

Advantageously, after or during the drawing of a workpiece, when the respective drawing tools are not being pressed against the workpiece, all of the drawing tools remain pivoted on their respective tool holder or at least one further identical drawing recess of all drawing tools is brought into a drawing position, because then the drawing tools are not stressed and a pivoting or bringing of the drawing tools into another position can be implemented relatively simply and operationally safely.

Furthermore, a drawing tool formed as a turntable is particularly advantageous, because a turntable in suitable configuration can provide a very good force transmission between drawing tool and tool holder. Moreover, the turntable is very simple to pivot, so that, by the least possible effort, the turntable can be pivoted and thus another drawing recess can be brought into position or the drawing recess can be pivoted particularly easily, for example by 180° or 90°. It will be understood that, in other configurations, the drawing tool can also be constructed in arbitrary different form.

It is also of advantage when a drawing plane spanned by the drawing line and the component of the pressing force directed toward the drawing line can be assigned to the drawing tool in at least one of its drawing positions. Such a drawing plane represents an operationally safe workflow of the drawing process because, by virtue of the drawing plane, the drawing tool can be properly adjusted or it is possible to check whether the drawing tool has been correctly adjusted. In particular, it is possible in this case to check the position of the drawing recesses relative to the drawing line and to correct them if necessary. Moreover, by such a drawing plane, it is possible to check the position of the drawing plane relative to the drawing dies, so that, for example, the drawing planes of the corresponding drawing tools lie parallel to one another. Thus erroneous positions of the drawing tools can be recognized and if necessary corrected in good time.

In order to be able to achieve a uniform force input, the turntable can be disposed in a bracing recess of the tool holder machined in the tool holder from a side of the tool holder disposed perpendicular to the drawing plane or can be braced on the rim thereof. Thus an operationally safe workflow can be provided in structurally simple manner, because such a bracing minimizes the risk of a nonuniform force input. In particular, a very uniform bracing can also minimize a possible wear.

Advantageously, the drawing tool can be pivoted around an axis that lies in the drawing plane or becomes pivoted around this axis, since in this way a very simple construction of the drawing tool is possible. For example, the drawing tool can therefore be constructed in such a way that the axis around which the drawing tool pivots lies at the center of a circular drawing tool. Understandably, such a construction of the drawing tool also delivers an optimal force transmission. If the axis around which the drawing tool pivots were to be situated offset relative to the drawing plane, the risk would exist that the force transmission could not be optimal, which could possibly result in a warping of the drawing tool.

The drawing tool may also be lockable or become locked by means of a locking mechanism, acting perpendicular to the drawing plane, on the associated tool holder. This locking mechanism is able to achieve a stable positioning of the drawing tool with structurally simple construction. In particular, the drawing tool can be held in its selected drawing position by the locking mechanism precisely when it is not being pressed against the workpiece. With opening of the lock, the drawing tool can then be easily pivoted or brought into other drawing positions.

Cumulatively or alternatively, the drawing tool can also be or become held in its respective drawing position by means of a retaining mechanism acting perpendicular to the drawing plane, whereby a stable securing of the drawing tool can likewise be achieved with structurally simple construction. In particular, on the one hand a loosening of the respective drawing tools perpendicular to the drawing plane can be prevented operationally safely by the retaining mechanism while the caterpillar-traction unit is running. Corresponding to the speed of revolution, considerable centrifugal forces, which can be countered by the retaining mechanism, then act on the drawing tools. On the other hand, a simple removal of the drawing tools can then be assured by an opening of the retaining mechanism.

It is particularly advantageous when the locking mechanism and the retaining mechanism comprise identical assemblies, because then a securing as stable as possible of the drawing tool can be achieved with structurally simple construction, because particularly complex assemblies are not additionally needed either for the locking mechanism or for the retaining mechanism. In this case, with suitable configuration, the locking mechanism can ensure the position of the respective drawing tool by a spring tension, whereas a bringing of the respective drawing tool into another drawing position or a removal of the drawing tool against the spring tension can be enabled.

In order to achieve a construction that is structurally as simple as possible, the drawing tool may be provided with a locking and/or retaining pin extending with a component parallel to the drawing plane and the tool holder may be provided with a corresponding locking and/or retaining recess. Such a construction ensures an extremely stable structure of the arrangement comprising drawing tool and tool holder, and does so with least possible structural complexity, because a stable securing of the drawing tool in its position on the tool holder can be ensured simply by the pin and the recess.

In addition, it is particularly advantageous when the two chains are block chains. Block chains can be extremely stable and thus may also be selected appropriately for great forces, so that it is possible, for example, to draw even workpieces with relatively large dimensions, for which substantially higher forces are necessary. Beyond this, block chains permit a particularly intimate contact with any bracing devices that may be present, with which pressing forces are to be applied.

Preferably the chains are block chains, which means that each of the chain members connected via connecting members is one block. Alternatively, block-and-plate chains may also be used if appropriate, in which not only blocks but also plates, which respectively are connected to one another movably as the chain by means of connecting members, are used as chain members. In this case, it is conceivable to provide several plates per chain member or even to provide yet another one or more plates on a chain member parallel to respectively a block.

A caterpillar-traction drawing machine for drawing of an elongated workpiece in a drawing direction along a drawing line through a drawing die, comprising the drawing die and a caterpillar-traction unit disposed in drawing direction down-line from the drawing die, with at least two revolving chains, which respectively have at least one tool holder respectively carrying a drawing tool in a drawing position, and with pressing means for application of a pressing force on the respective drawing tools with a component directed toward the drawing line, wherein the respective drawing tool has at least one drawing recess, in its drawing position in a gripping region of the caterpillar-traction unit is resting with one of its drawing recesses on the workpiece and by means of the pressing means is pressed against the workpiece, can also be characterized in that the two chains are block chains and are respectively braced via an idler rolling chain comprising idler rollers on respectively one pressing beam, in order to minimize the influence of any fatigue phenomena that may exist.

With suitable procedure, especially a wear can be minimized both for the idler rollers or even on the chain members. The latter is true in particular in distinction from EP 0 864 382 A1, in which individual roller cages and no idler rollers are disclosed, or else in distinction to DE 199 47 806 A1 or to EP 0 548 723 B2, which disclose no block chain but instead block-and-plate chain at this place. In this case, especially the combination of idler roller chains on the one hand with block chains on the other hand proves accordingly to be particularly advantageous, because a particularly uniform running of the components on one another can be assured.

Preferably, each chain member of the block chain is provided with two plates on one side and with one plate on an oppositely disposed side, wherein the one plate of a chain member is situated respectively between the two plates of a neighboring chain member and one connecting member, preferably a bolt, is guided through these three plates, in order to connect the chain members in hinged manner.

Depending on specific configuration, the bolt may then also carry chain rollers, in which chain wheels can engage, in order to drive the chain, which ultimately may assure a particularly stable and uniform drive.

Preferably, the idler rollers extend over the entire width of the chain members and/or of the pressing beam, which achieves a correspondingly uniform distribution of the pressing forces. This uniform distribution in turn minimizes the risk of wear.

Preferably, over the entire width of the chain members and/or of the respective pressing beam, the idler rollers are in contact therewith, which accordingly achieves a particularly uniform force distribution. Accordingly, the risk of wear can be further reduced hereby.

The block chains also make it possible to exploit even the blocks as tool holders, which leads to a compact structure of the caterpillar-traction unit.

Advantageously, at least one of the tool holders is formed by a chain member of the chain, because such a chain member permits an extremely compact structure of the chain. Hereby it is possible to reduce, to a minimum, especially any transverse torques and the like that may exist that lead to further stresses, since the chains can then be constructed as compactly as possible in the height.

Preferably, chain rollers are also seated on the respective connecting members, so that the chains can be easily engaged as well as driven or deflected by chain wheels.

The pressing force can be applied by any pressing means, known from the prior art, with which such caterpillar-traction units are equipped. Thus, for example, idler rollers, which in turn are braced against pressing beams and act correspondingly on the tool holders, are also able to revolve in synchronization. Likewise, correspondingly adjusted roller beams or bracing beams acting on the chain rollers can be used cumulatively therewith or alternatively thereto.

By the use of block chains, it is possible in particular to ensure a relatively large-area contact between revolving idler rollers and the respective chain, which in turn can counteract the risk of fatigue phenomena.

It is also of advantage when the two chains are provided with a tool holder on each of their chain members. Hereby the entire chain becomes much more stable, because each of the chain members is stressed equally. Thus the chain is suitable for substantially higher forces or permits an improved force distribution to the workpiece. In particular, it is of advantage to combine such an arrangement with a block chain, since then a very high drawing tool density can be achieved.

It will be understood that the features of the approaches described in the foregoing or in the claims may also be combined as the case may be, in order that the advantages can be exploited correspondingly cumulatively.

BRIEF DESCRIPTION OF THE DRAWINGS

Further advantages, objectives and properties of the present invention will be explained on the basis of following description of exemplary embodiments, which in particular are also illustrated in the attached drawing. In the drawing:

FIG. 2 shows a section through two chain members of the caterpillar-traction drawing machine according to FIG. 1;

FIG. 3 shows an overhead view of one of the drawing tools of the chain members illustrated in FIG. 2;

FIG. 4 shows a perspective view of the drawing tool according to FIG. 3. slanted with respect to its drawing recess;

FIG. 5 shows a perspective view of the drawing tool according to FIGS. 3 and 4, slanted with respect to its locked and/or retaining pin;

DETAILED DESCRIPTION OF PREFERRED EMBODIMENTS

Figure 10:
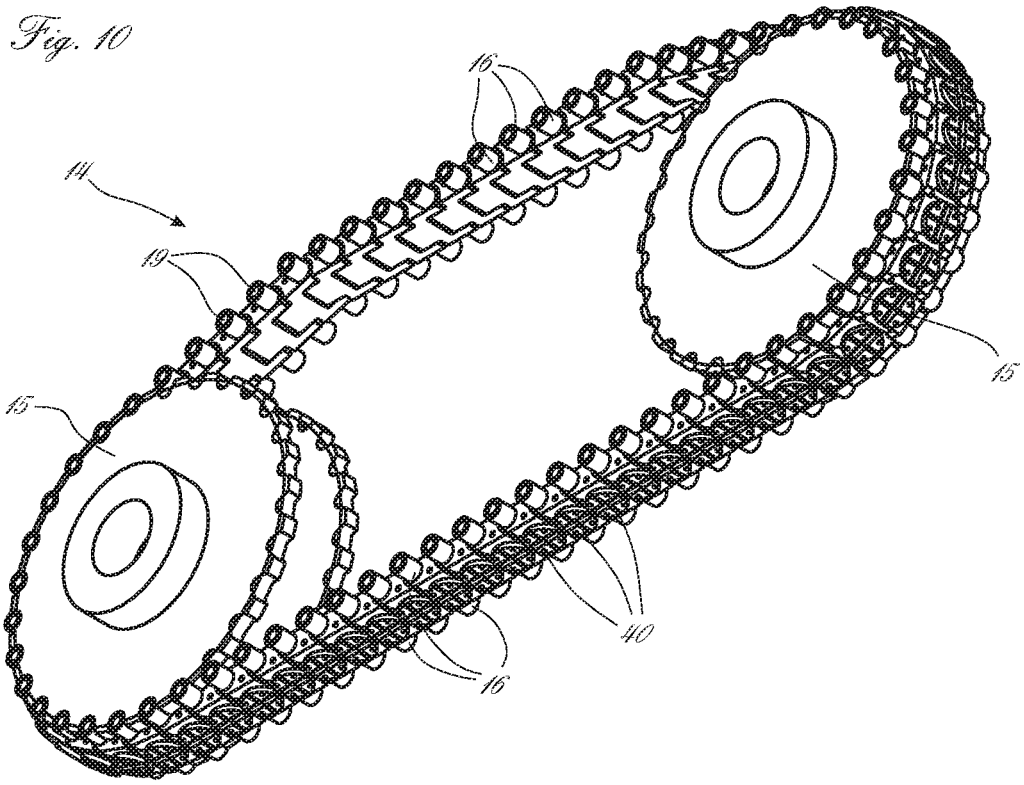
FIG. 10 shows a perspective view of one of the chains of the caterpillar-traction unit of the caterpillar-traction drawing machine according to FIG. 1 and associated chain wheels with the drawing tools according to FIGS. 8 and 9.

The caterpillar-traction drawing machine 10 illustrated in the exemplary embodiments comprises above and below a drawing line 20 respectively two chain wheels 15, around which chains 14 travel. In this exemplary embodiment, the chain wheels 15 are constructed as chain-wheel pairs, but in other embodiments may be configured simply or with a higher number of chain-wheel leaves. As illustrated in particular in FIG. 10, the chains 14 are formed as block chains, wherein each of the chain members of the chains 14 are provided with two lateral plates on one end face and with one central plate on an oppositely disposed end face. In this case the plates of a chain member are situated on both sides of a central plate of another chain member, wherein the two chain members are connected to one another by a bolt 19, which passes through plates and and as a connecting member connects them with one another.

In these exemplary embodiments, chain rollers 16, in which the chain wheels 15 are able to engage in order to drive and to guide the chains 14, are disposed on the bolts.

In these exemplary embodiments, the chain members of the chains 14 are formed as tool holders 30 (see, e.g. FIG. 2), although in different embodiments these chain members may also be optionally capable of carrying separate tool holders, but are less compactly structured. The tool holders 30 then carry drawing tools 40, which are able to interact in drawing manner with a workpiece 11 to be drawn.

The arrangement of the chains 14 and of the chain wheels 15 forms a caterpillar-traction unit 13. The drawing line 20 is situated between the two chains 14. By means of the caterpillar-traction unit 13, the workpiece 11 can be drawn in drawing direction 21 along the drawing line 20 through a drawing die 12, whereby the caterpillar-traction drawing machine 10 is able to fulfill its basic task.

In order to be able to apply the drawing forces through the drawing die 12 in drawing direction 21, the caterpillar-traction unit 13 is provided with pressing beams 82, on which idler rollers 80, which are respectively connected to idler roller chains 81, are able to travel, which in turn again travel together with the chain members of the chains 14, because they travel on the side of the chain members that face away from the drawing tools 40. In this way, a component 22 of a pressing force directed toward the drawing line 20 can be applied in a gripping area 18.

In exemplary embodiments here, the idler roller chains 81 revolve between the chain-wheel pairs of the chain wheels 15. In different exemplary embodiments, respectively shorter idler roller chains 81 may be provided, which respectively revolve in front of the chain wheels 15.

By the chains 14 and the drawing line 20, it is possible to define a drawing plane 23 (see FIG. 2), which lies parallel to the revolving chains 14 and intersects the drawing line 20. Perpendicular to this drawing plane 23, it is possible to define a further plane 25, which likewise intersects the drawing line 20. The two chains 14 are then respectively disposed above and below or on the two sides of this plane 25.

As can be inferred directly from FIG. 2, the idler rollers 80 of the two idler roller chains 81 extend respectively parallel to the plane 25 over the width of the chain members or of the tool holders 30 and of the respective pressing beam 82. Within the scope of the necessary tolerances and measurement accuracies, they are also in contact with the chain members or tool holders and respective pressing beam over the entire width, and so a very even force distribution can be ensured. This even force distribution is also ensured in particular by the use of block chains as chains 14 and by the use of idler roller chains 81 in order to guide the idler rollers 80.

The drawing tools 40 are situated on a side 31 of the respective tool holders 30 disposed perpendicular to the drawing plane 23. These sides 31 of the tool holders 30 are respectively turned toward the plane 25.

In the exemplary embodiments illustrated here, the chain members secure the drawing tool 40 by means of a locking and retaining mechanism 90.

Thus, in the exemplary embodiments illustrated in FIGS. 1 to 10, the drawing tools 40 are secured in their position via a bolt 34, which engages in a locking and retaining recess 92 of a locking and retaining pin 91. For this purpose, the bolt 34 is pressed with a spring 36 against a locking face 45 (see, e.g. FIG. 3) and behind a retaining undercut 46 (see FIG. 5), which are respectively provided on the locking and retaining pin 91, so that the drawing tool on the one hand is secured in its pivoted position relative to the tool holder 30 by the pressing pressure against the locking face 45 and is also prevented by the retaining undercut 46 from escaping from the tool holder 30.

The bolt 34 is connected to a handle 35, by which it is able to release the retaining undercut 46 against the spring force of the spring 36. This arrangement makes it possible to remove the drawing tool 40 as needed. With suitable choice of the spring force of the spring 36, a pivoting of the respective drawing tool is already possible without actuation of the handle 35, but can be facilitated by an actuation of the handle 35.

For the spring 36 to be preloaded, it is retained by means of a securing cover 37, which is firmly inserted in a seat or recess 38 for the bolt 34 and the spring 36.

In the exemplary embodiments illustrated in FIGS. 1 to 10, the locking and retaining pins 91 are aligned along an axis 24, which lies in the drawing plane 23. As is immediately apparent, the locking and retaining mechanism 90 in these exemplary embodiments are realized by identical or double-acting assemblies, which structurally represents a simple and compact approach.

The drawing tools 40 of all exemplary embodiments are provided with drawing recesses 41 (see, e.g. FIG. 3), which are able to interact in drawing manner with the respective workpieces 11 and are adapted to the respective workpieces 11 in ways that are suitable and known in themselves.

In this case, the drawing tools of the exemplary embodiment according to FIGS. 1 to 10 and 12 to 15 are formed as turntables, which are respectively provided with a bracing land 44, by means of which the turntables can be braced on the rim 33 of a bracing recess 32 of the tool holders 30. This arrangement permits a particularly uniform bracing, which respectively is able to reduce fatigue phenomena of the respective materials.

In order that the turntable can be pivoted simply, it is respectively provided in the exemplary embodiments of FIGS. 1 to 10 with actuating bores 43, in which a pivoting lever can be inserted in order to facilitate pivoting. If appropriate, mechanisms may also be provided correspondingly in the exemplary embodiment illustrated in FIGS. 12 to 15.

Figure 1:
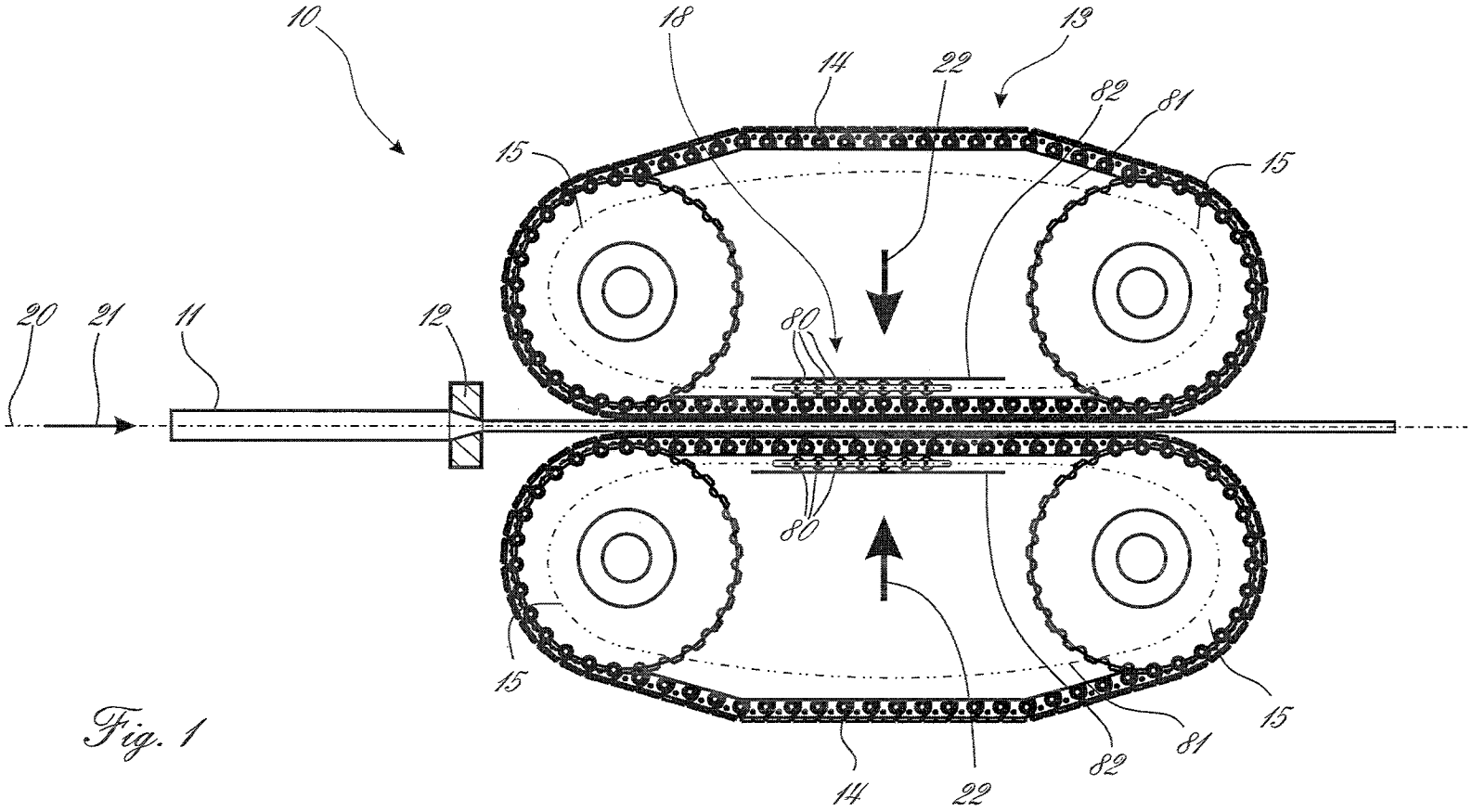
FIG. 1 schematically shows a side view of a caterpillar-traction drawing machine.
Figure 6:
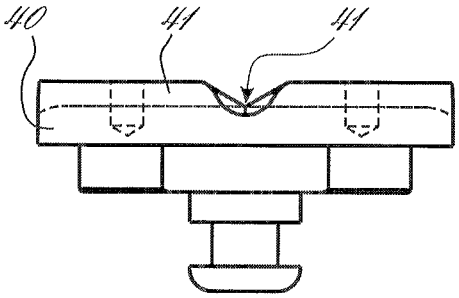
FIG. 6 shows a view in drawing direction of a further drawing tool.
Figure 8:
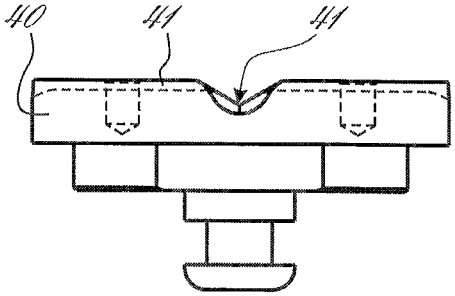
FIG. 8 shows a view in drawing direction of a further drawing tool.
Figure 7:
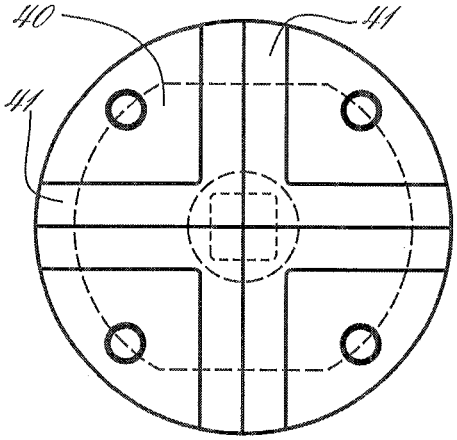
FIG. 7 shows an overhead view of the drawing tool according to FIG. 6.
Figure 9:
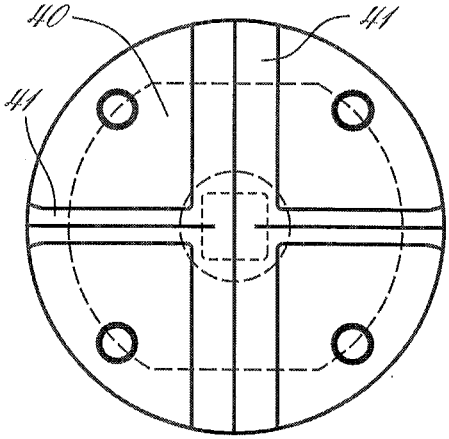
FIG. 9 shows an overhead view of the drawing tool according to FIG. 8.

As is immediately apparent, the exemplary embodiment illustrated in FIGS. 2 to 5 is provided with a drawing tool 40 having only one drawing recess 41. By pivoting the drawing tool 40 by 180°, it is possible to change the direction of action between drawing tool 40 and the workpiece 11 or the tool holder 30, which in turn allows fatigue phenomena to be reduced. This pivoting is also possible in the exemplary embodiments according to FIGS. 6 to 9, in which respectively two drawing recesses 41 are provided. A pivoting of 90° permits a change between the drawing recesses 41, wherein the drawing recesses 41 in the exemplary embodiment illustrated in FIGS. 6 and 7 are identically structured, which permits a process opposing fatigue phenomena even better, whereas the drawing recesses 41 in the exemplary embodiment illustrated in FIGS. 8 and 9 are formed differently, so that different workpieces 11 may also be drawn and disposed in these.

Figure 11:
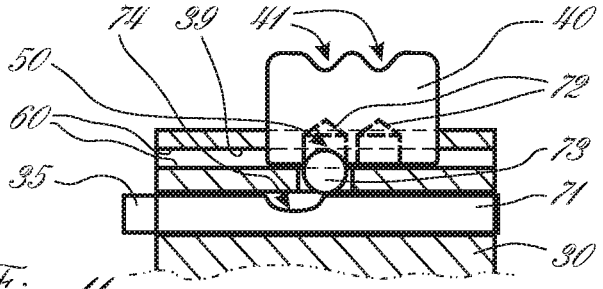
FIG. 11 shows a view in drawing direction of a further drawing tool.
Figure 12:
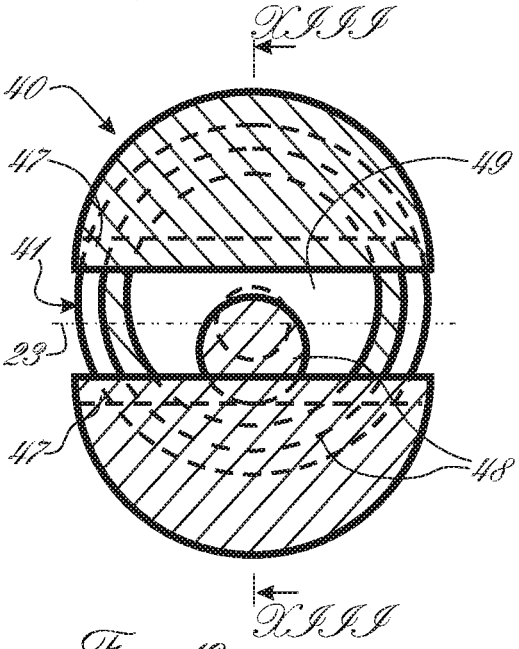
FIG. 12 shows a section through a further drawing tool along line XII-XII in FIG. 13 with drawing jaws pushed apart from one another.
Figure 13:
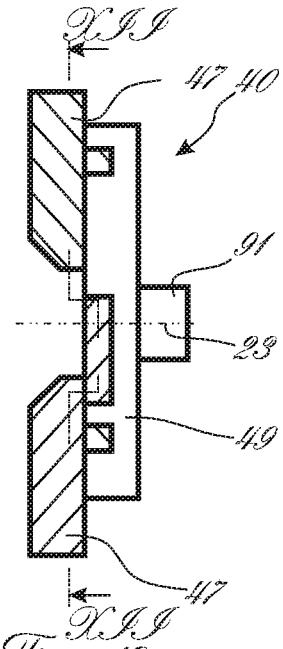
FIG. 13 shows a section through the drawing tool according to FIG. 12 along line XIII-XIII in FIG. 12.
Figure 14:
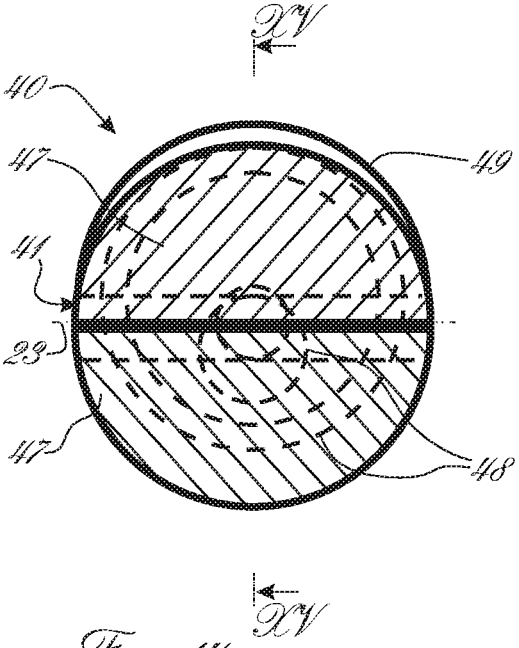
FIG. 14 shows a section through the drawing tool according to FIGS. 12 and 13 along line XIV-XIV in FIG. 15 with drawing jaws pushed together.
Figure 15:
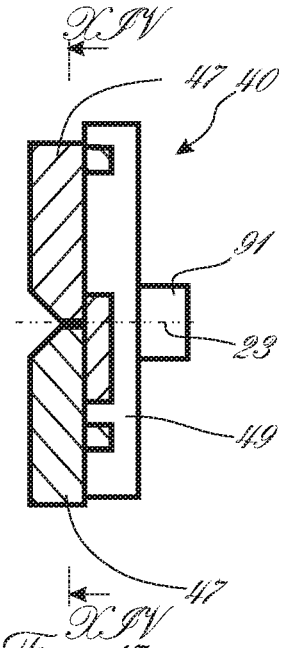
FIG. 15 shows a section through the drawing tool according to FIGS. 12 to 14 along line XV-XV in FIG. 14.
Figure 16:
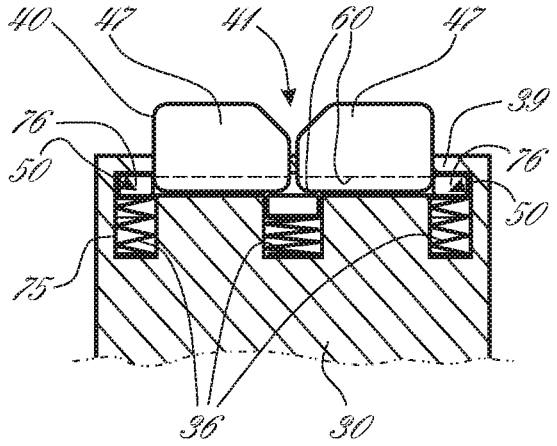
FIG. 16 shows a view in drawing direction of a further drawing tool with closed drawing jaws.
Figure 17:
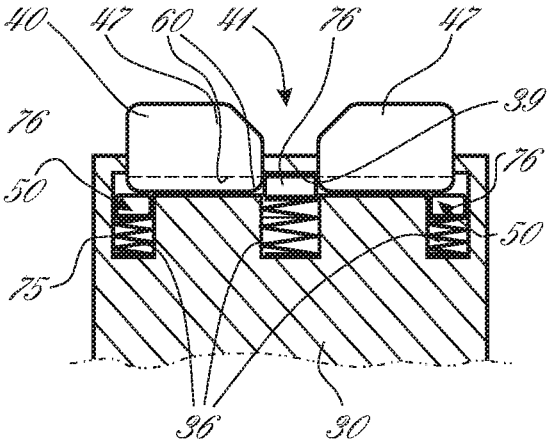
FIG. 17 shows a view in drawing direction of the drawing tool according to FIG. 16 with open drawing jaws.
Figure 18:
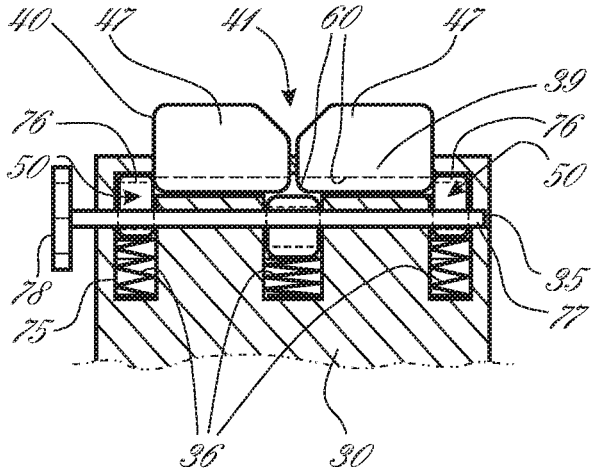
FIG. 18 shows a view in drawing direction of a further drawing tool with closed drawing jaws.
Figure 19:
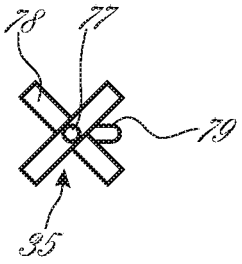
FIG. 19 shows an overhead view of a handle of the exemplary embodiment according to FIG. 18.

The exemplary embodiment illustrated in FIG. 11 comprises a drawing tool 40, which is displaceable laterally along the plane 25, has two identical drawing recesses 41 and is held laterally displaceably in the tool holder 30 via a guide rail 39. Via a locking and retaining bolt or pin 71, which is equipped with a handle 35, a locking and retaining ball 73 can be released from a locking and retaining bore 72, because an indentation 74 in the locking and retaining pin 71 of the locking and retaining ball 73 is made available as a retraction capability. The drawing tool 40 can then be displaced laterally and if necessary can even be removed from the tool holder 30. As in the exemplary embodiment illustrated in FIGS. 6 and 7, it is therefore possible to change between two identical drawing recesses 41, in order in this way to relieve the drawing tool 40.

By split drawing jaws 47, the practical embodiments illustrated in FIGS. 12 to 19 permit a change of the drawing recesses 41, so that they can be adapted to different workpieces 11. For this purpose, the drawing jaws 47 of the exemplary embodiment illustrated in FIGS. 12 to 15 are mounted by means of an eccentric pivoting guide 48 in a bearing member 49, which in turn is provided with a locking and retaining pin 51, 61, in order that the entire arrangement can be pivoted by 180°, which in turn serves for relief of the drawing tool 40. In contrast, by a staggered pivoting of the individual drawing jaws 47, their spacing can be varied.

In the exemplary embodiments illustrated in FIGS. 16 to 19, two drawing jaws 47 are held by means of guide rails 39 in the tool holder 30 in such a way as to be laterally displaceable parallel to the plane 25. For locking, springs 36 that urge spacers 76 in the direction of the plane 25 are mounted in spring holders 75. In the exemplary embodiments illustrated in FIGS. 16 and 17, the spacers 76 must be urged manually against the springs 36, in order that the drawing jaws 47 can be displaced laterally. In the exemplary embodiment illustrated in FIGS. 18 and 19, a handle shaft 77 with a cam 79, which can be actuated by lever 78, is used for this purpose. Depending on specific implementation, the spacers, just as described in the foregoing, can be used for both a locking and also a retaining, because they can also prevent or permit a lateral removal of the drawing jaws 47 from the guide rail 39.

Although only a few embodiments of the present invention have been shown and described, it is to be understood that many changes and modifications may be made thereunto without departing from the spirit and scope of the invention.

What is claimed is:

1. A caterpillar-traction drawing machine for drawing of an elongated workpiece in a drawing direction along a drawing line comprising:

(a) a drawing die; and (b) a caterpillar-traction unit disposed in the drawing direction down-line from the drawing die;

wherein the caterpillar-traction unit comprises:

at least first and second revolving chains having at least first and second tool holders, respectively, carrying first and second drawing tools, respectively, in first and second drawing positions, respectively;

a press for application of a pressing force on the first and second drawing tools with a component of the pressing force directed toward the drawing line; and (c) a gripping region;

wherein the first and second drawing tools are provided with at least first and second drawing recesses, respectively, in the first and second drawing positions, respectively, in the gripping region and rest with the first and second drawing recesses, respectively, on the workpiece and by the press are pressed against the workpiece;

wherein the first drawing recesses comprise two first drawings recesses disposed at right angles to one another on the first drawing tool; and wherein at least the first drawing tool is fastened pivotally on the first tool holder and is pivotable without removing the first drawing tool from the first tool holder.

2. The caterpillar-traction drawing machine according to claim 1, wherein the two first drawing recesses are different drawing recesses.

3. The caterpillar-traction drawing machine according to claim 1, wherein the first drawing tool is formed as a turntable.

4. The caterpillar-traction drawing machine according to claim 3, wherein a drawing plane spanned by the drawing line and the component of the pressing force directed toward the drawing line is assigned to the first drawing tool in at least the first drawing position of the first drawing tool.

5. The caterpillar-traction drawing machine according to claim 4, wherein the turntable is disposed in a bracing recess of the first tool holder machined in the first tool holder from a side of the first tool holder disposed perpendicular to the drawing plane or is braced on a rim of a bracing recess of the first tool holder machined in the first tool holder from the side of the first tool holder disposed perpendicular to the drawing plane.

6. The caterpillar-traction drawing machine according to claim 4, wherein the first drawing tool is pivotable or becomes pivoted around an axis lying in the drawing plane.

7. The caterpillar-traction drawing machine according to claim 4, wherein the first drawing tool is lockable or becomes locked on the first tool holder by a locking mechanism acting perpendicular to the drawing plane.

8. The caterpillar-traction drawing machine according to claim 7, wherein the first drawing tool is or becomes held in the first drawing position by a retaining mechanism acting perpendicular to the drawing plane.

9. The caterpillar-traction drawing machine according to claim 8, wherein the locking mechanism and the retaining mechanism comprise identical assemblies.

10. The caterpillar-traction drawing machine according to claim 1, wherein the first drawing tool is provided with at least one of a locking pin and a retaining pin extending with a component parallel to a drawing plane and the first tool holder is provided with at least one of a corresponding locking recess and a holding recess.

11. The caterpillar-traction drawing machine according to claim 1, wherein the first and second chains are block chains.

12. The caterpillar-traction drawing machine according to claim 1, wherein at least the first tool holder is formed by a chain member of the first chain.

13. The caterpillar-traction drawing machine according to claim 1, wherein the first and second chains are provided with the first and second tool holders, respectively, on first and second chain members of the first and second chains, respectively.

14. The caterpillar-traction drawing machine according to claim 1, wherein the two first drawing recesses are identical drawing recesses.

15. A drawing method for drawing an elongated workpiece in a drawing direction along a drawing line through a drawing die, the method comprising:

(a) disposing a caterpillar-traction unit down-line in the drawing direction from the drawing die, wherein the caterpillar-traction unit comprises at least first and second revolving chains having at least first and second tool holders, respectively, carrying first and second drawing tools, respectively, in first and second drawing positions, respectively, wherein the first and second drawing tools are provided with at least first and second drawing recesses, respectively, wherein the first drawing recesses comprise two first drawings recesses disposed at right angles to one another on the first drawing tool;

(b) disposing and revolving the first and second revolving chains so that the first and second drawing tools come into contact in the first and second drawing positions with a first drawing recess of the two first drawing recesses of the first drawing tool and are pressed against the workpiece to apply traction forces on the workpiece; and (c) drawing the workpiece;

wherein after or during drawing of the workpiece when the first and second drawing tools are not being pressed against the workpiece, at least the first drawing tool remains on the first tool holder and is pivoted without removing the first drawing tool from the first tool holder.

16. The drawing method according to claim 15, wherein, the second drawing tool has a second drawing recess and after or during the drawing of the workpiece, when the first and second drawing tools are not being pressed against the workpiece, both of the first and second drawing tools remain pivoted on the first and second tool holders, respectively, or a further identical drawing recess of the two first drawing recesses of the first drawing tool and at least one further identical second drawing recess of the second drawing tool are brought into the first and second drawing positions, respectively.

17. The drawing method according to claim 15, wherein the two first drawing recesses are different drawing recesses.

18. The drawing method according to claim 15, wherein the two first drawing recesses are identical drawing recesses.

19. A caterpillar-traction drawing machine for drawing of an elongated workpiece in a drawing direction along a drawing line comprising:

(a) a drawing die; and (b) a caterpillar-traction unit disposed in the drawing direction down-line from the drawing die;

wherein the caterpillar-traction unit comprises:

at least first and second revolving chains having at least first and second tool holders, respectively, carrying first and second drawing tools, respectively, in first and second drawing positions, respectively;

a press for application of a pressing force on the first and second drawing tools with a component of the pressing force directed toward the drawing line; and (c) a gripping region;

wherein the first and second drawing tools are provided with at least first and second drawing recesses, respectively, in the first and second drawing positions, respectively, in the gripping region and rest with the first and second drawing recesses, respectively, on the workpiece and by the press are pressed against the workpiece;

wherein the first drawing recesses comprise two first drawings recesses disposed at right angles to one another on the first drawing tool;

wherein at least the first drawing tool is fastened pivotally on the first tool holder and is pivotable without removing the first drawing tool from the first tool holder; and wherein the first and second chains are block chains and are braced via first and second idler roller chains, respectively comprising idler rollers on first and second pressing beams, respectively.

20. The caterpillar-traction drawing machine according to claim 19, wherein the idler rollers of the first and second idler roller chains extend over an entire width of at least one of: first and second chain members of the first and second chains and the first and second pressing beams, respectively.

21. The caterpillar-traction machine according to claim 20, wherein the idler rollers of the first and second idler roller chains are in contact with at least one of: the first and second chain members of the first and second chains and the first and second pressing beams, respectively, over the entire width.

22. The caterpillar-traction drawing machine according to claim 19, wherein the two first drawing recesses are different drawing recesses.

23. The caterpillar-traction drawing machine according to claim 19, wherein the two first drawing recesses are identical drawing recesses.

24. A caterpillar-traction drawing machine for drawing of an elongated workpiece in a drawing direction along a drawing line comprising:

(a) a drawing die; and (b) a caterpillar-traction unit disposed in the drawing direction down-line from the drawing die;

wherein the caterpillar-traction unit comprises:

at least first and second revolving chains having at least first and second tool holders, respectively, carrying first and second drawing tools, respectively, in first and second drawing positions, respectively;

a press for application of a pressing force on the first and second drawing tools with a component of the pressing force directed toward the drawing line; and (c) a gripping region;

wherein the first and second drawing tools are provided with at least first and second drawing recesses, respectively, in the first and second drawing positions, respectively, in the gripping region and rest with the first and second drawing recesses, respectively, on the workpiece and by the press are pressed against the workpiece;

wherein the first drawing recesses comprise two first drawings recesses disposed at right angles to one another on the first drawing tool; and wherein at least the first drawing tool is fastened displaceably on the first tool holder and is displaceable without removing the first drawing tool from the first tool holder.

25. The caterpillar-traction drawing machine according to claim 24, wherein the two first drawing recesses are different drawing recesses.

26. The caterpillar-traction drawing machine according to claim 24, wherein the two first drawing recesses are identical drawing recesses.

27. A drawing method for drawing an elongated workpiece in a drawing direction along a drawing line through a drawing die, the method comprising:

(a) disposing a caterpillar-traction unit down-line in the drawing direction from the drawing die, wherein the caterpillar-traction unit comprises at least first and second revolving chains having at least first and second tool holders, respectively, carrying first and second drawing tools, respectively, in first and second drawing positions, respectively, wherein the first and second drawing tools are provided with at least first and second drawing recesses, respectively, wherein the first drawing recesses comprise two first drawings recesses disposed at right angles to one another on the first drawing tool;

(b) disposing and revolving the first and second revolving chains so that the first and second drawing tools come into contact in the first and second drawing positions with a first drawing recess of the two first drawings recesses of the first drawing tool and are pressed against the workpiece to apply traction forces on the workpiece; and (c) drawing the workpiece;

wherein after or during drawing of the workpiece when the first and second drawing tools are not being pressed against the workpiece, at least the first drawing tool remains on the first tool holder and is displaced without removing the first drawing tool from the first tool holder.

28. The drawing method according to claim 27, wherein the two first drawing recesses are different drawing recesses.

29. The drawing method according to claim 27, wherein the two first drawing recesses are identical drawing recesses.

* * * * *